US007975389B2

(12) United States Patent
Bozikis et al.

(10) Patent No.: US 7,975,389 B2
(45) Date of Patent: Jul. 12, 2011

(54) RAZOR HANDLE HAVING ERGONOMIC GRIPPING AREAS

(75) Inventors: Ioannis Bozikis, Koukaki-Athens (GR); Yiannis Psimadas, Vrilissia-Athens (GR); Alexis Angelides, Alimos-Athens (GR)

(73) Assignee: Bic-Violex SA, Anixi, Attiki (GR)

( * ) Notice: Subject to any disclaimer, the term of this patent is extended or adjusted under 35 U.S.C. 154(b) by 41 days.

(21) Appl. No.: 11/815,485

(22) PCT Filed: Feb. 3, 2005

(86) PCT No.: PCT/EP2005/001648

§ 371 (c)(1),
(2), (4) Date: Aug. 3, 2007

(87) PCT Pub. No.: WO2006/081842

PCT Pub. Date: Aug. 10, 2006

(65) Prior Publication Data

US 2008/0163500 A1 Jul. 10, 2008

(51) Int. Cl.
*B26B 21/52* (2006.01)

(52) U.S. Cl. ..... 30/527; 30/32

(58) Field of Classification Search ..... 30/526, 30/527, 50, 32; 15/167.1; 16/430
See application file for complete search history.

(56) References Cited

U.S. PATENT DOCUMENTS

| | | | | |
|---|---|---|---|---|
| 545,789 A | | 9/1895 | Gaffney | |
| 876,317 A | * | 1/1908 | Booth | 40/314 |
| 1,636,867 A | | 7/1927 | Robinson | |
| 2,263,885 A | * | 11/1941 | McGauley | 15/143.1 |
| 2,335,547 A | | 11/1943 | Smith | |
| 2,378,605 A | | 6/1945 | Watson | |
| 2,703,449 A | | 3/1955 | Haynes | |
| 3,045,342 A | | 7/1962 | Diehl | |
| 3,067,446 A | * | 12/1962 | McGauley | 15/143.1 |
| 3,080,651 A | | 3/1963 | Cas | |
| 3,302,230 A | * | 2/1967 | Poppelmann | 15/167.1 |

(Continued)

FOREIGN PATENT DOCUMENTS

CN 1 243 629 2/2000

(Continued)

OTHER PUBLICATIONS

International Search Report for International Application No. PCT/EP2005/001648, mailed Nov. 16, 2005.

*Primary Examiner* — Kenneth E. Peterson
*Assistant Examiner* — Sean Michalski
(74) *Attorney, Agent, or Firm* — Jones Day

(57) ABSTRACT

A razor handle made of a rigid core and a layer of compressible elastomeric material. The razor handle includes a head portion, located at the front end of the razor handle, and includes a bearing structure for connection to a razor head. The razor handle also includes a body portion having an upper surface, a lower surface opposite the upper surface, an upper front gripping area that includes a plurality of spaced projections protruding from the upper surface, and a lower front gripping area located opposite the upper front gripping area. The razor handle also includes a plurality of spaced projections protruding from the lower surface. The upper front gripping area is centered on a point located at a distance of at least 3 cm from a front end of the head portion.

11 Claims, 15 Drawing Sheets

U.S. PATENT DOCUMENTS 3,762,453 A 10/1973 Merrow et al.
D229,795 S 1/1974 Holohan
4,031,775 A * 6/1977 Petty ..... 74/551.9
4,091,497 A * 5/1978 Bade ..... 16/430
4,182,258 A 1/1980 Presser
4,198,746 A 4/1980 Trotta
4,283,808 A * 8/1981 Beebe ..... 15/145
4,327,488 A 5/1982 Connolly
4,392,303 A 7/1983 Ciaffone
4,399,582 A * 8/1983 Ernest et al. ..... 15/176.4
4,428,116 A 1/1984 Chen et al.
4,444,711 A * 4/1984 Schad ..... 264/243
4,587,730 A * 5/1986 Iten ..... 30/541
4,601,101 A 7/1986 McGready
4,712,301 A 12/1987 Saito
4,721,021 A * 1/1988 Kusznir ..... 81/22
4,736,928 A 4/1988 Smilkstein
4,739,536 A * 4/1988 Bandera et al. ..... 16/430
4,828,420 A 5/1989 Otsuka et al.
4,949,457 A 8/1990 Burout, III
4,969,231 A 11/1990 Mader et al.
4,974,286 A * 12/1990 Stowell et al. ..... 16/421
5,018,733 A 5/1991 Buand
5,027,511 A * 7/1991 Miller ..... 30/526
5,031,319 A 7/1991 Althaus et al.
5,038,472 A 8/1991 Iderosa
5,052,071 A * 10/1991 Halm ..... 15/167.1
5,054,154 A * 10/1991 Schiffer et al. ..... 15/167.1
5,070,614 A 12/1991 Hardin et al.
5,107,590 A 4/1992 Burout, III et al.
5,199,191 A 4/1993 Moumdjian
5,261,430 A * 11/1993 Mochel ..... 132/322
5,265,337 A 11/1993 Lowder et al.
5,287,584 A * 2/1994 Skinner ..... 15/167.1
5,305,490 A * 4/1994 Lundgren ..... 15/167.1
5,316,316 A 5/1994 Lai
5,333,383 A 8/1994 Ferraro
5,333,595 A 8/1994 Heffron
5,339,482 A * 8/1994 Desimone et al. ..... 15/167.1
5,347,717 A 9/1994 Ts'ai
5,353,464 A * 10/1994 Atkins et al. ..... 15/167.1
5,373,602 A * 12/1994 Bang ..... 15/167.1
5,390,572 A 2/1995 Gakhar et al.
5,402,573 A 4/1995 Laniado
5,497,551 A 3/1996 Apprille, Jr. et al.
5,530,989 A * 7/1996 Remmert et al. ..... 16/430
5,669,835 A 9/1997 Tiura
5,687,485 A 11/1997 Shurtleff et al.
5,696,339 A 12/1997 Brennan
5,774,921 A * 7/1998 Harrison et al. ..... 15/145
5,781,958 A * 7/1998 Meessmann et al. ..... 15/167.1
5,784,790 A 7/1998 Carson, III et al.
5,822,869 A 10/1998 Metcalf et al.
5,828,052 A * 10/1998 Reynolds et al. ..... 235/472.01
5,839,163 A * 11/1998 Hellmann ..... 30/526
5,855,071 A 1/1999 Apprille, Jr. et al.
5,890,296 A 4/1999 Metcalf et al.
5,903,978 A 5/1999 Prochaska et al.
5,915,791 A * 6/1999 Yin et al. ..... 30/41
D412,810 S 8/1999 Alfred
5,956,851 A 9/1999 Apprille, Jr. et al.
6,049,945 A * 4/2000 Prevot et al. ..... 16/110.1
6,108,869 A * 8/2000 Meessmann et al. ..... 16/430
6,112,412 A 9/2000 Richard
6,122,826 A 9/2000 Coffin et al.
6,138,361 A 10/2000 Richard et al.
6,141,875 A 11/2000 Andrews
6,145,900 A 11/2000 Jung
6,149,538 A 11/2000 Tiura
6,164,172 A 12/2000 Huang
6,266,888 B1 7/2001 Zowaski
6,308,416 B1 10/2001 Bosy et al.
6,481,104 B1 11/2002 Parker et al.
6,588,113 B2 7/2003 Bozikis et al.
6,591,456 B2 7/2003 DeLuca et al.
6,598,303 B2 7/2003 Bosy et al.
6,684,511 B2 2/2004 McCambridge et al.
6,694,626 B2 2/2004 Kludjian et al.
6,739,053 B2 5/2004 McCambridge et al.
6,749,788 B1 6/2004 Holden et al.
D500,174 S 12/2004 Gray
6,837,637 B1 * 1/2005 Beck et al. ..... 401/6
6,880,253 B1 4/2005 Gyllerstrom
6,886,262 B2 * 5/2005 Ohtsubo et al. ..... 30/526
6,977,619 B2 12/2005 March et al.
6,986,206 B2 1/2006 McCambridge et al.
6,996,870 B2 * 2/2006 Hohlbein ..... 15/110
7,014,379 B2 * 3/2006 Cheng ..... 401/6
7,065,882 B2 6/2006 Haberstroh
7,086,160 B2 8/2006 Coffin et al.
7,146,675 B2 * 12/2006 Ansari et al. ..... 15/167.1
7,200,942 B2 4/2007 Richard
7,297,303 B2 * 11/2007 Kraemer ..... 264/243
7,334,286 B2 * 2/2008 Kayser ..... 15/167.1
7,383,619 B2 * 6/2008 Gross et al. ..... 16/430
7,458,125 B2 * 12/2008 Hohlbein et al. ..... 15/143.1
7,461,458 B2 * 12/2008 Peyser et al. ..... 30/532
D588,308 S 3/2009 Wonderley
7,523,525 B2 4/2009 Lawless
7,526,869 B2 5/2009 Blatter et al.
2002/0059733 A1 5/2002 Bozikis et al.
2002/0138992 A1 10/2002 Richard
2002/0184770 A1 12/2002 Peyser
2003/0046819 A1 3/2003 Ferraro et al.
2003/0061718 A1 4/2003 Dansreau
2003/0070259 A1 4/2003 Brown et al.
2003/0070309 A1 4/2003 Brown et al.
2003/0177648 A1 9/2003 Zeiter
2004/0020053 A1 2/2004 Wain
2004/0035003 A1 2/2004 Stiles
2004/0093735 A1 5/2004 Ohtsubo et al.
2004/0103545 A1 6/2004 Dansreau
2004/0170464 A1 9/2004 Polczynski
2004/0177518 A1 9/2004 Leventhal
2004/0221425 A1 11/2004 Lawless
2004/0261271 A1 12/2004 Coffin et al.
2005/0102847 A1 5/2005 King
2005/0198843 A1 9/2005 Royle
2006/0037160 A1 * 2/2006 Kayser ..... 15/167.1
2006/0283025 A1 12/2006 Follo et al.
2008/0229583 A1 9/2008 Fischer et al.
2009/0038167 A1 * 2/2009 Peyser et al. ..... 30/532

FOREIGN PATENT DOCUMENTS

DE 295 11 444 U1 11/1995
DE 10 2004 059 517 A1 6/2006
EP 0 353 919 B1 9/1992
EP 0 418 726 B1 1/1995
EP 0 987 088 A1 3/2000
EP 1 046 471 A1 10/2000
EP 1 182 015 A1 2/2002
EP 1 337 382 A1 5/2002
EP 1 226 906 A1 7/2002
EP 1 140 441 B1 3/2004
EP 1 531 030 5/2005
EP 1 531 030 A2 5/2005
FR 2 640 182 A1 6/1990
GB 2 246 314 A 1/1992
GB 2 282 773 A 4/1995
GB 2 402 096 A 12/2004
WO WO 90/13442 A1 11/1990
WO WO 96/11778 A2 4/1996
WO WO 97/09155 A1 3/1997
WO WO 02/34483 A1 5/2002
WO WO 03/005858 A2 1/2003
WO WO 03/033223 4/2003
WO WO 2004/018163 3/2004
WO WO 2004/094114 A2 11/2004
WO WO 2005/007355 A1 1/2005
WO WO 2005/009689 A2 2/2005
WO WO 2005/084896 A1 9/2005

* cited by examiner

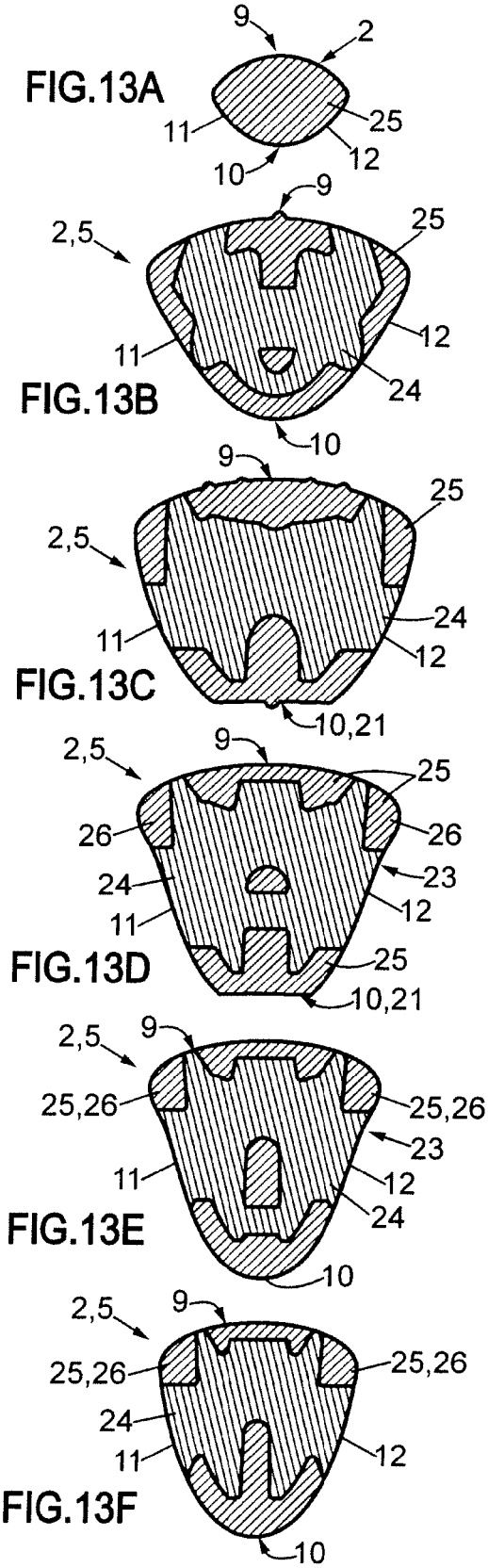
FIG.13A
9
2
11
25
10
12
FIG.13B
2,5
9
25
11
12
24
10
FIG.13C
2,5
9
25
11
24
12
10,21
FIG.13D
2,5
9
25
26
26
24
23
11
12
25
10,21
FIG.13E
2,5
9
25,26
25,26
23
11
12
24
10
FIG.13F
2,5
9
25,26
25,26
24
11
12
10
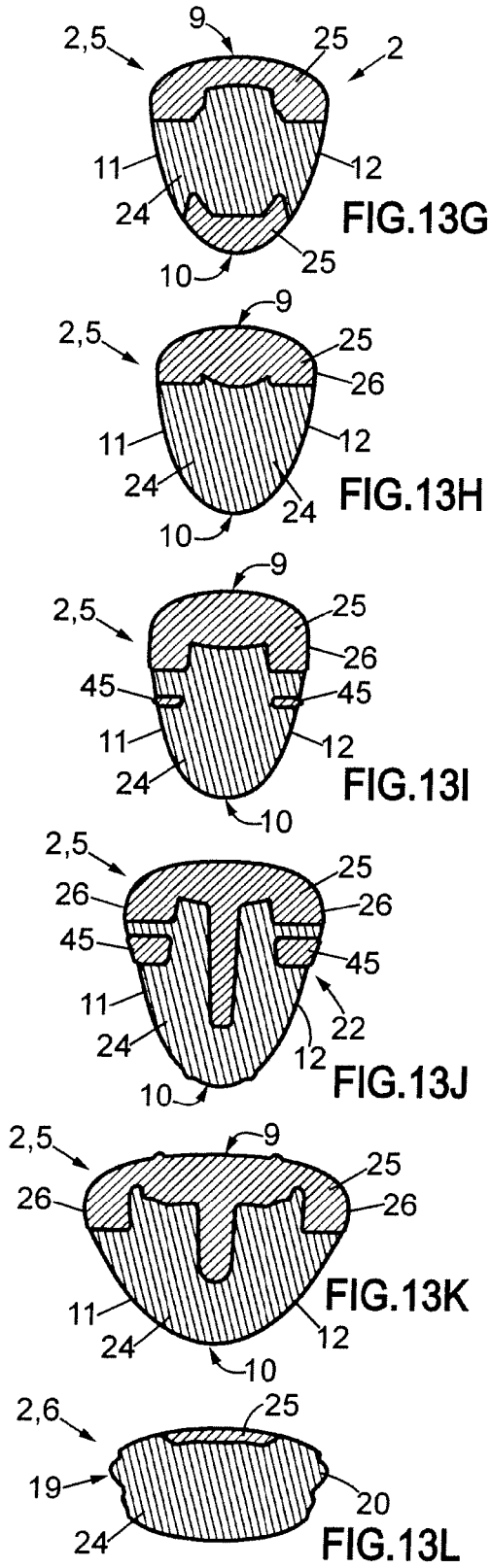
FIG.13G
2,5
9
25
2
11
12
24
25
10
FIG.13H
2,5
9
25
26
11
12
24
24
10
FIG.13I
9
2,5
25
26
45
45
11
12
24
10
FIG.13J
2,5
25
26
26
45
45
11
22
24
12
10
FIG.13K
2,5
9
25
26
26
11
24
12
10
FIG.13L
2,6
25
19
20
24

RAZOR HANDLE HAVING ERGONOMIC GRIPPING AREAS

CROSS-REFERENCE TO RELATED APPLICATIONS

This application is a national stage application of International Application No. PCT/EP2005/001648, filed on Feb. 3, 2005, the entire contents of which are incorporated herein by reference.

BACKGROUND OF THE INVENTION

1. Field of the Invention

Embodiments of the present invention relate to a safety razor. More particularly, embodiments of the present invention relate to an ergonomic razor handle provided with gripping areas for enhancing comfort of hand grasping during shaving operations.

2. Description of the Related Art

Numerous razor handles comprising a body portion for hand grasping and a head portion at a front end thereof to which a razor head is mounted via an appropriate bearing structure are known.

Various kinds of razor handles have been proposed in the past for improving hand grasping by means of gripping areas provided on a top surface of the handle.

U.S. Pat. No. 5,027,511 to Miller shows a rectilinear composite razor handle structure having a housing structure with an array of spaced apertures and a compressible resilient insert structure including projection portions that extend through the apertures. One drawback of such a structure is that is does not facilitate certain grasping positions, such as one in which the index finger is applied against the top surface of the handle, in the vicinity of the razor head portion, for because the index finger tends to slip toward the lateral sides of the housing structure, especially under wet and soapy conditions.

U.S. Patent Application Publication No. 2004/0103545 to Dansreau shows a razor handle having an outer layer made from a compressible elastomeric material and formed around an inner rigid core. The outer layer has a top surface provided with projections deemed to enhance the grip of the handle. One drawback of such a razor handle is that it cannot provide sufficient feeling of the actual position of the fingers to the user, because the gripping projections are substantially uniform along the handle.

Although the products corresponding to these patents have found (or may find) a market, it is believed that they fail to allow excellent grasping and comfort while shaving, especially in certain grasping positions.

SUMMARY OF THE INVENTION

It is an object of embodiments of the present invention to provide a razor handle with improved ergonomics, in order to enhance the grasping and comfort qualities of the razor handle while shaving.

The proposed razor handle comprises a head portion provided at a front end thereof, with a bearing structure for connection to a razor head, and an elongated body portion having an upper surface provided with a local upper front gripping area comprising a plurality of spaced projections protruding from the upper surface. The local front gripping area is centered on a point located at a distance of at least 3 cm from the front end of the head portion.

Such a design provides improved gripping and finger rest comfort in certain shaving positions. The index finger of the user is guided by touch feeling to the gripping area, which is located at a distance from the skin to be shaved, ensuring precise and comfortable shaving.

The above and other objects and advantages of embodiments of the present invention will become apparent from the following detailed description of the embodiments of the present invention, considered in conjunction with the accompanying drawings.

BRIEF DESCRIPTION OF THE DRAWINGS

FIGS. 13A to 13L are cross-sectional views of the razor handle of FIG. 12, taken along the lines XIIIA-XIIIA to XIIIL-XIIIL, respectively;

DESCRIPTION

Figure 1:
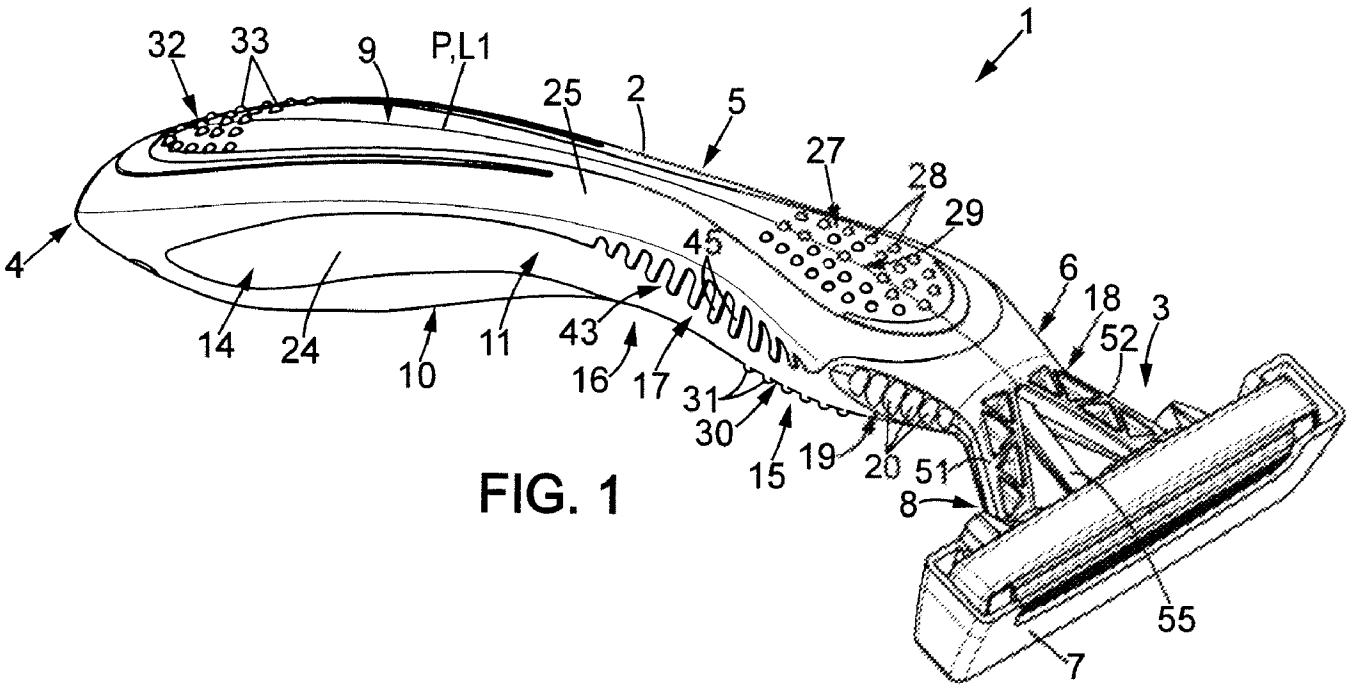
FIG. 1 is a front top perspective view of a razor, according to an embodiment of the present invention.
Figure 2:
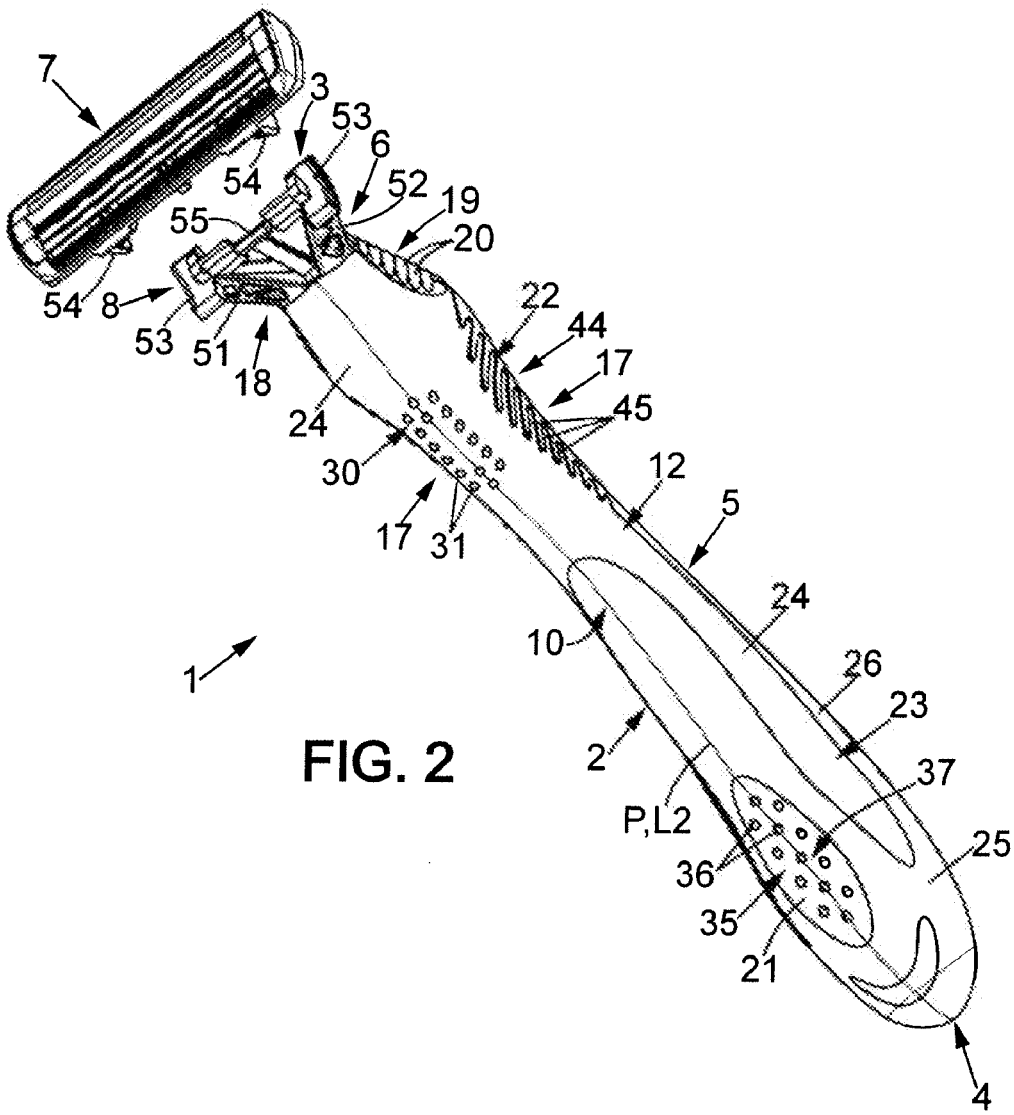
FIG. 2 is an exploded bottom perspective view of the razor of FIG. 1.

Referring to FIGS. 1 and 2, there is shown a safety razor 1 comprising a handle 2 defining a front end 3 and a back end 4 opposite the front end 3, and having an elongated body portion 5 for hand grasping of the handle 2, extending longitudinally from the back end 4 to a location near the front end 3. The razor further comprises a head portion 6 in the continuation of the body portion 5 up to the front end 3. The razor 1 also comprises a razor head 7 including blades mounted in a head structure defining, in a known manner, a guard and a cap, and connected, at the front end 3, to the head portion 6 by means of bearing structures 8.

The following description will often make reference to different hand grasping positions of the handle 2. Various positions are illustrated in FIGS. 17A to 17G, where the numbers in circles designate the fingers of the human hand: ① the thumb, ② the index, ③ the second finger, ④ the ring finger and ⑤ the small finger. The depicted positions of FIGS. 17A, 17B, 17C, 17D, 17E, 17F and 17G are respectively called first position, second position, third position, fourth position, fifth position, sixth position and seventh position.

Figure 3:
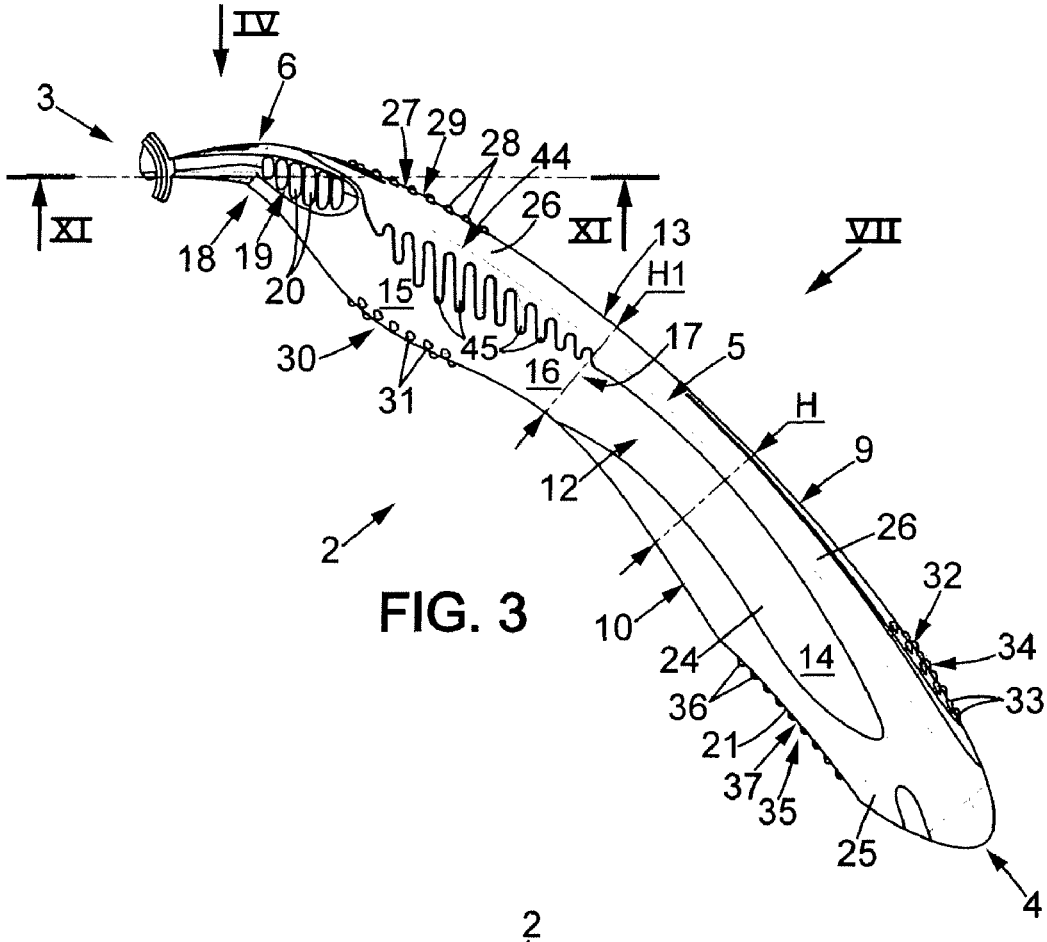
FIG. 3 is a side elevational view of the handle of the razor of the preceding Figs.

Referring now to FIG. 3, it can be seen that the razor handle 2 has a generally curved shape. The handle 2 defines a length of between approximately 12 cm and 14 cm, as measured along its curvature between the front end 3 and the back end 4. The body portion 5 is approximately 10 cm to approximately 12 cm in length, whereas the head portion 6 is approximately 2 cm to 3 cm in length. In one embodiment, the razor handle 2 is 13.5 cm in length, the body portion 5 is 11 cm in length and the head portion 6 is 2.5 cm in length.

Handle 2 has, extending along its length, an upper surface 9, a lower surface 10 opposite the upper surface 9, and side surfaces 11, 12 joining the upper surface 9 and lower surface 10. Handle 2 is symmetrical with respect to a median plane P made visible in FIGS. 1 and 2 through its lines $L_1$, L2 of intersection with the handle 2, respectively on the upper surface 9 and the lower surface 10. As depicted in FIG. 3, upper surface 9 is, from a side view, arcuate and convex in the longitudinal direction. It can also be seen in FIGS. 13A to 13L that upper surface 9 is also arcuate and convex in cross section (i.e. perpendicular to the symmetry plane P of handle 2).

Figure 5:
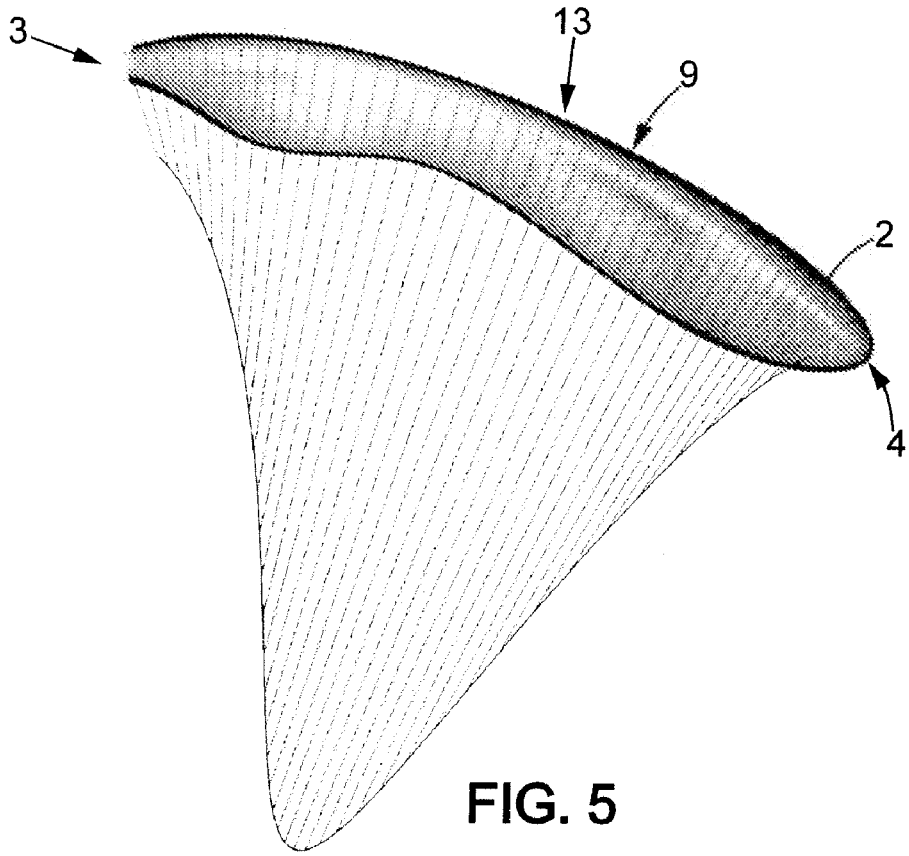
FIG. 5 is a diagram showing the distribution of the centers of curvature for the edge curve of the top surface of the razor handle for the razor of FIG. 1.
Figure 6:
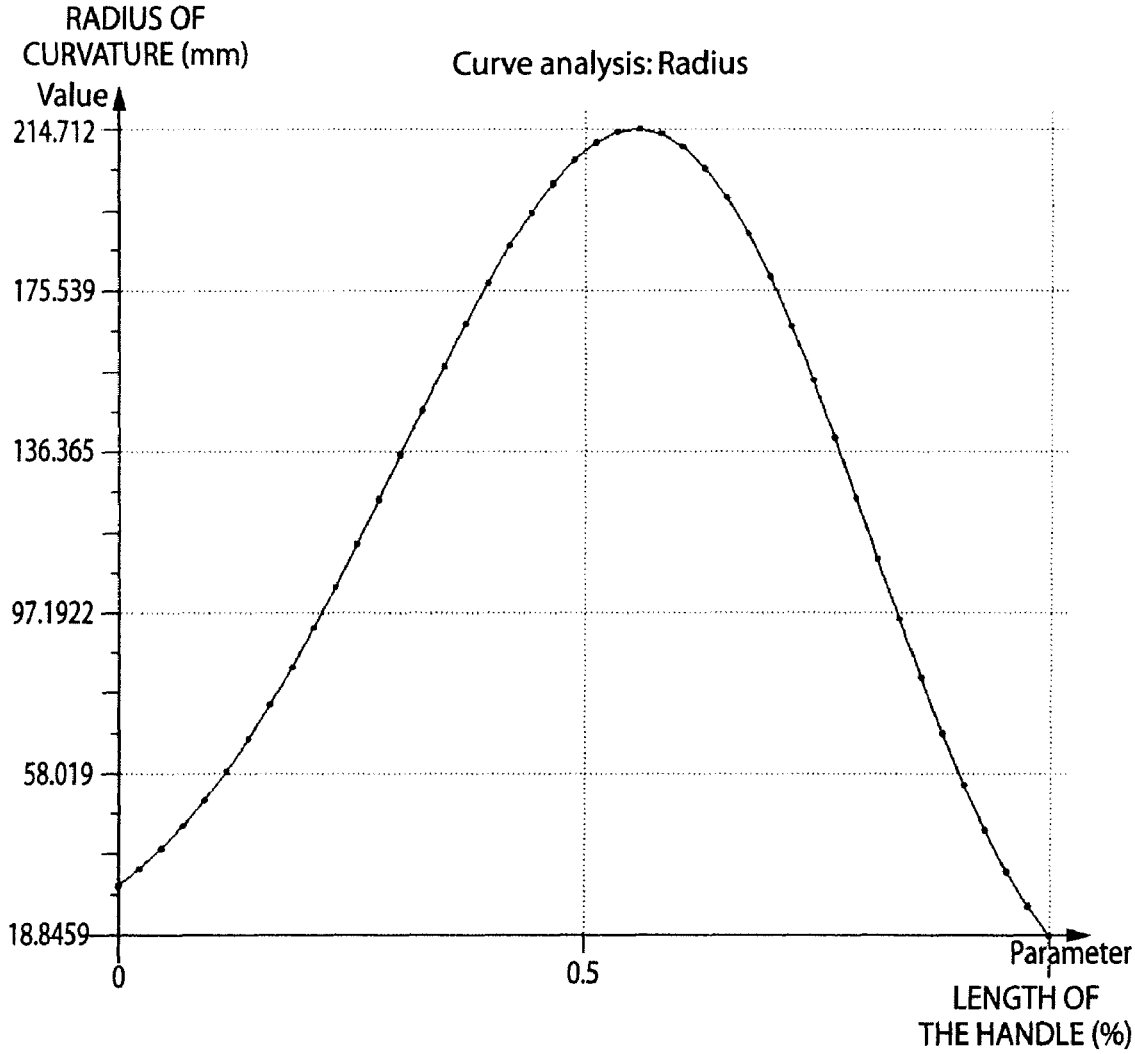
FIG. 6 is a diagram showing the evolution of the radius of curvature for the edge curve of the top surface of the razor handle for the razor of FIG. 1, along the length thereof.

As depicted in FIGS. 5 and 6, which diagrammatically show the evolution, from a side view, of the radius of curvature of upper surface 9 (in other words, the radius of curvature of the line L1) along the length of the razor handle 2, the radius of curvature is not constant but continuously increases longitudinally (i.e. along the length of the razor handle 2), from the back end 4 toward a median location 13 in the vicinity of half the length of the razor handle 2, whereas the radius of curvature continuously decreases, longitudinally, from the median location 13 toward the front end 3 of the handle 2. In other words, the upper surface 9 is curved more near its ends 3, 4, where the radius of curvature is approximately 2 cm, and more flat in the vicinity of its middle, where the radius of curvature is equal to or more than approximately 20 cm. Such a shape of the upper surface 9 increases ergonomics of the handle 2, its curvature following the natural curvature of the human hand, thereby enhancing grasping comfort.

Figure 17A:
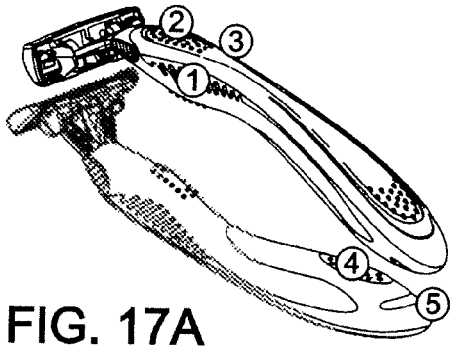
FIGS. 17A to 17G are perspective views showing a razor of the preceding Figs. and its mirror image, and illustrate various ways of grasping the razor handle, depending of the shaving positions.
Figure 17B:
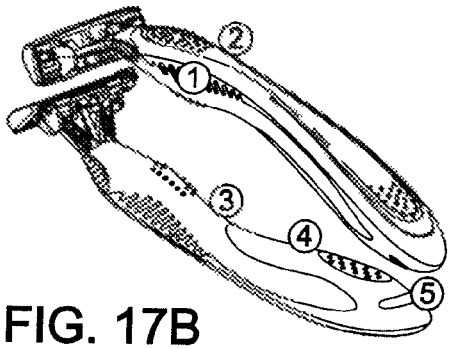
Figure 17C:
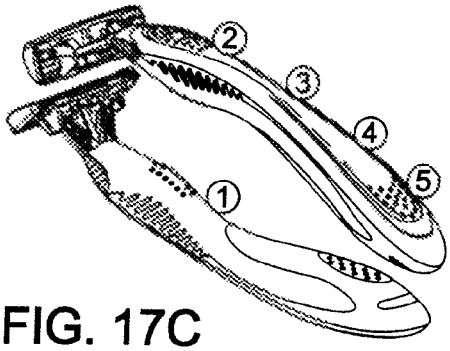
Figure 17D:
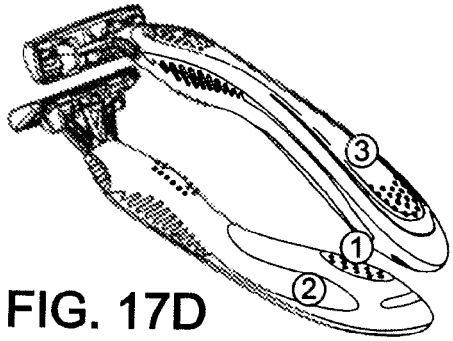

The upper surface 9 and the lower surface 10 together define, from a side view in the symmetry plane P, a height H of the handle 2. It is visible in FIG. 3 that the height is not constant along the length of the handle 2, where the lower surface 10 is convex in the vicinity of the ends 3, 4 of the handle 2 and concave towards the middle thereof. More specifically, the smallest height H1 of the handle 2 is located about two thirds of the length of the body portion 5, measured from to back end 4 toward the front end 3, so that the handle 2 defines two thicker portions 14, 15 separated by a relatively thinner portion 16. This allows for easier and more comfortable finger positioning before and during shaving operations, especially in the third position (FIG. 17C).

Figure 4:
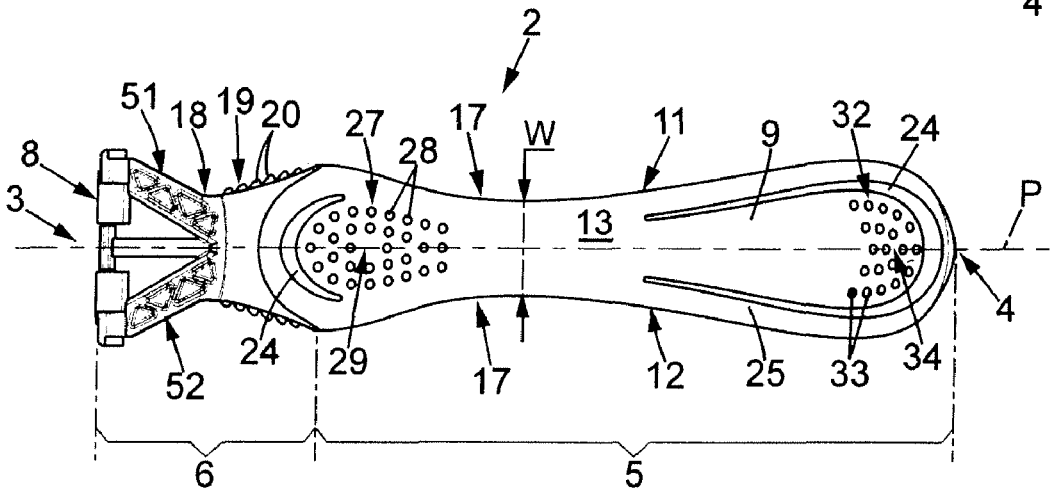
FIG. 4 is a top plan view of the razor handle of FIG. 3 from the perspective of arrow IV in FIG. 3.
Figure 7:
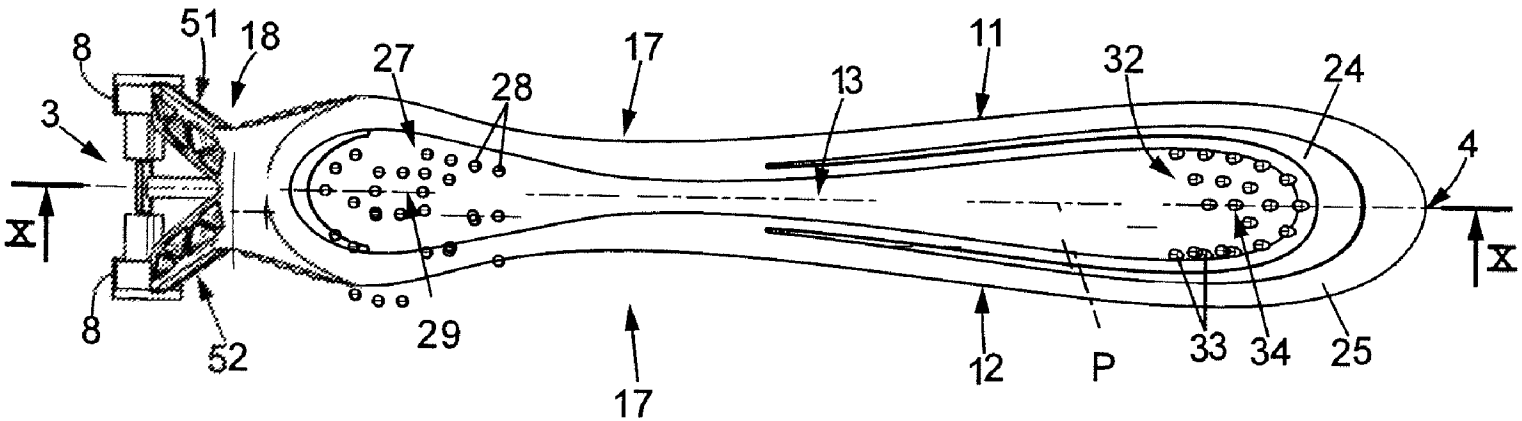
FIG. 7 is a top plan view of the razor handle of FIG. 3, from the perspective of arrow VII in FIG. 3.

Referring to FIGS. 4 and 7, it can be seen that, from a top view, the body portion 5 has a neck portion 17 in the vicinity of the head portion 6, located at approximately two thirds of the length of the body portion 5, measured from the back end 4, and where the width W of the razor, i.e. the distance between the side surfaces 11, 12, is minimized.

More specifically, from a top view, each side surface 11, 12 extends substantially along an arc of a circle in the neck portion 17. Such a circle has a radius of approximately 5 cm to 10 cm, and preferably approximately 6 cm. This particular shape of the neck portion 17 aims at facilitating hand grasping, especially in the first position (FIG. 17A), which appears to be the most common shaving position.

As depicted in FIGS. 4 and 7, the width W of the handle 2 is maximized in the vicinity of the back end 4 and at the junction between the body portion 5 and the head portion 6. A secondary neck portion 18, defined in the head portion 6 is provided with opposite side gripping areas 19 comprising a series of spaced ribs 20. This enhances finger gripping of the handle 2, especially in a shaving position where the thumb and the index finger are positioned very close to the razor head 7 for satisfying the need for precise shaving, such as mustache trimming. In this position, the body portion 5 of the handle 2 is either free or grasped between the small finger and the palm of the hand.

As depicted in FIGS. 13A to 13K, which are cross sections of the handle 2 taken regularly all along the body portion 5, the side surfaces 11, 12 converge at the opposite ends of the upper surface 9, all along the length of the body portion 2. In other words, the body portion 5 has a generally triangular shape in cross section, except in a zone located near the back end 4 of the handle 2, where the lower surface 10 is provided with a flat or concave recess 21 designed for facilitating finger gripping in certain hand grasping positions. In this zone, the general shape of the body portion 5 in cross section is trapezoidal, as depicted in FIGS. 13C and 13D.

It can be seen in FIGS. 13B to 13K that, except in the immediate vicinity of the back end 4 of the razor handle 2 (FIG. 13A), the angular aperture defined between the side surfaces is less than approximately 90°. Such a triangular shape allows for firm gripping and comfortable grasping of the handle 2, especially in the first position (FIG. 17A).

It can further be seen in FIGS. 13A to 13K that each side surface 11, 12 is convex, except in the vicinity of the head portion 6 (i.e. in the neck portion 17), where the head portion 6 has a concave portion 22 designed for facilitating hand grasping, especially in the first, second, and sixth positions (FIGS. 17A, 17B and 17F, respectively), and also except in the vicinity of the back end 4, where each side surface 11, 12 has a concave portion 23 of approximately 1 cm in length located at a distance of approximately 3 cm from the back end 4. The side surfaces 11, 12 are also designed for facilitating hand grasping, especially in the fourth position (FIG. 17D) and seventh position (FIG. 17G).

The razor handle 2 is of the composite type and is comprised of a rigid core 24 made of a moldable nonelastomeric material such as polypropylene or ABS resin, and a layer 25 made of a compressible elastomeric material (thermoplastic rubber) such as Santoprene. The rigid core 24 provides structural strength to the handle 2 while the layer 25 of compressible elastomeric material provides the softness required for comfortable hand grasping and firm finger gripping in any shaving position.

As can be seen, for example, in FIGS. 13A-13L, the layer 25 of compressible elastomeric material defines a majority of the upper surface 9 on the body portion 5 and it also defines part of the lower surface 10, from the back end 4 to the median location 13, and it even overflows the side surfaces 11, 12 at 26.

The rigid core 24 defines: part of the side surfaces 11, 12 between the side overflowing portions 26 of the layer 25 of compressible elastomeric material, from a location near the back end 4 to the median location 13; part of the side surfaces 11, 12; the whole lower surface 10 from the median location 13 to the head portion 6; and substantially the whole head portion 6, including the side ribs 20, which are therefore integral with the rigid core 24.

As depicted in FIGS. 1 and 4, the body portion 5 is provided with a local upper front gripping or finger rest area 27 comprising a plurality of spaced projections 28 in the form of pins protruding from the upper surface 9. The gripping area 27 is centered on a point 29 that is located at a distance of at least 3 cm from the front end 3. Such a location provides improved gripping and finger rest comfort in certain shaving positions, such as the first position (FIG. 17A), where the index finger of the user is located at a distance from the skin to be shaved, allowing for precise and comfortable shaving.

As depicted in FIG. 1, the layer 25 of compressible elastomeric material forms the upper front gripping area 27, the projections being therefore integral with layer 25, thereby increasing the gripping properties of the handle 2, at least in the first position (FIG. 17A). It can be seen in FIG. 4 that the upper front gripping area 27 is shaped like a bullet having a longitudinal length of approximately 2 cm, which suits the tip of the index finger tip.

The body portion 5 is also provided with a local lower front gripping area 30 located opposite the upper front gripping area 27, comprising a plurality of spaced projections 31 protruding from the lower surface 10. Because, at this location, the lower surface 10 of the body portion 5 is formed by the rigid core 24, the projections 31, in the form of pins, are integral with the rigid core 24. The lower front gripping area 30 provides, in combination with the upper front gripping area 27, enhanced gripping properties in certain shaving positions, such as the one (not depicted) where the razor handle 2 is grasped between the thumb and the index finger in the vicinity of the head portion 6, whereas the rest of the handle 2 is free. Such a shaving position, in which the index finger rests onto the upper front gripping area 27 while the thumb rests onto the lower front gripping area 30, is sometimes used for precise shaving operations, such as mustache trimming.

The body portion 5 is also provided with a local upper back gripping area 32 comprising a plurality of spaced projections 33 in the form of pins protruding from the upper surface 9, and centered on a point 34 located at a distance of approximately 2 cm from the back end 4 of the body portion 5. The body portion also comprises a local lower back gripping area 35, located substantially opposite the upper back gripping area 32, comprising a plurality of spaced projections 36 in the form of pins protruding from the recess 21 in the lower surface 10 and centered on a point 37 located at a distance of approximately 2.5 cm from the back end 4. Because, in this region, the upper and lower surfaces 9, 10 are defined by the layer 25 of compressible elastomeric material, the pins 33, 36 of the upper and lower back gripping areas 32, 35 are integral with the elastomeric layer 25. This enhances hand grasping in certain shaving positions, such as the fourth position (FIG. 17D), or in a position where the razor handle is held between the index finger and the thumb, the thumb resting on the lower back gripping area 35 whereas the index finger rests on the upper back gripping area 32, the handle 2 being in continuation with the fingers. Such a shaving position is used in particular for horizontal cheek shaving.

Figure 17E:
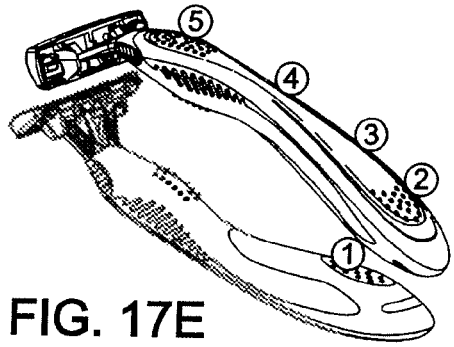

The lower back gripping area 35 can also be used in combination with the upper front gripping area 27 in certain shaving positions such as the first position (FIG. 1) and the fifth position (FIG. 17E). This is why the distance between these areas 27 and 35 has to be carefully defined. In order to provide excellent finger gripping and comfortable hand grasping in these shaving positions, the distance between the lower back gripping area 35 and the upper front gripping area 27, measured along the curvature of the handle 2, is between approximately 7 cm and 9 cm. In the depicted embodiment, this distance is approximately 8 cm, which suits the majority of male hands.

Figure 10:
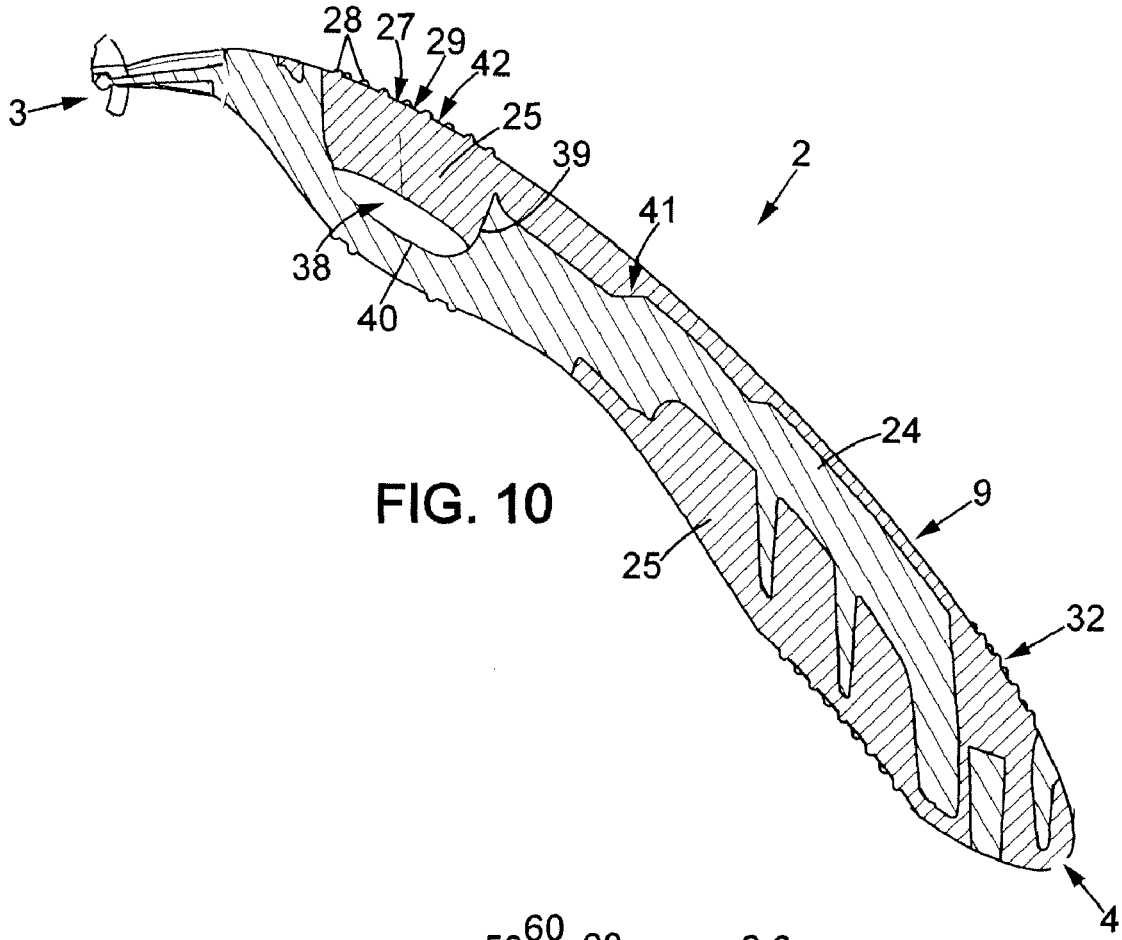
FIG. 10 is a cross-sectional view of the razor handle of FIG. 7, taken along the line X-X.

As depicted in FIG. 10, the handle 2 includes an air cushion 38 underneath the upper front gripping area 27 located or disposed between the rigid core 24 and the layer 25 of compressible elastomeric material. More specifically, in the region underneath the upper front gripping area 27, the rigid core 24 defines a groove 39 that is filled with the compressible material, except for in the bottom 40 of the groove 39, where the air cushion 38 is located. Such an air cushion 38, acting like a compression spring, adds softness and compressibility to the upper surface 9 of the handle 2 in the region of the upper front gripping area 27, where the index finger rests in the first position (FIG. 17A), thereby enhancing the gripping and comfort properties of the handle 2 by providing more conformability to the finger tip.

The air cushion 38 is built up during the manufacturing process of the handle 2, in which there is provided a step of molding the rigid core 24, followed by a step of molding the layer 25 of compressible elastomeric material over the rigid core 24 after a short predetermined rest time (few seconds) where the rigid core 24 is allowed to cool. The resin of which the core 24 is made of is injected at a primary injection point 41 located near the middle of the handle 2, whereas the compressible elastomeric material is injected at a secondary injection point 42 that faces the groove 39 near the head portion. The flow of pressurized elastomeric material generates an air bubble which is imprisoned at the bottom 40 of the groove 39, thereby building up the air cushion 38 between the rigid core 24 and the elastomeric layer 25.

As depicted in FIGS. 1-3, in the region of the neck portion 17, the handle 2 is provided with opposite side gripping areas 43, 44 comprising a row of spaced fins 45 made of elastomeric material, protruding from the rigid core 24.

Figure 14:
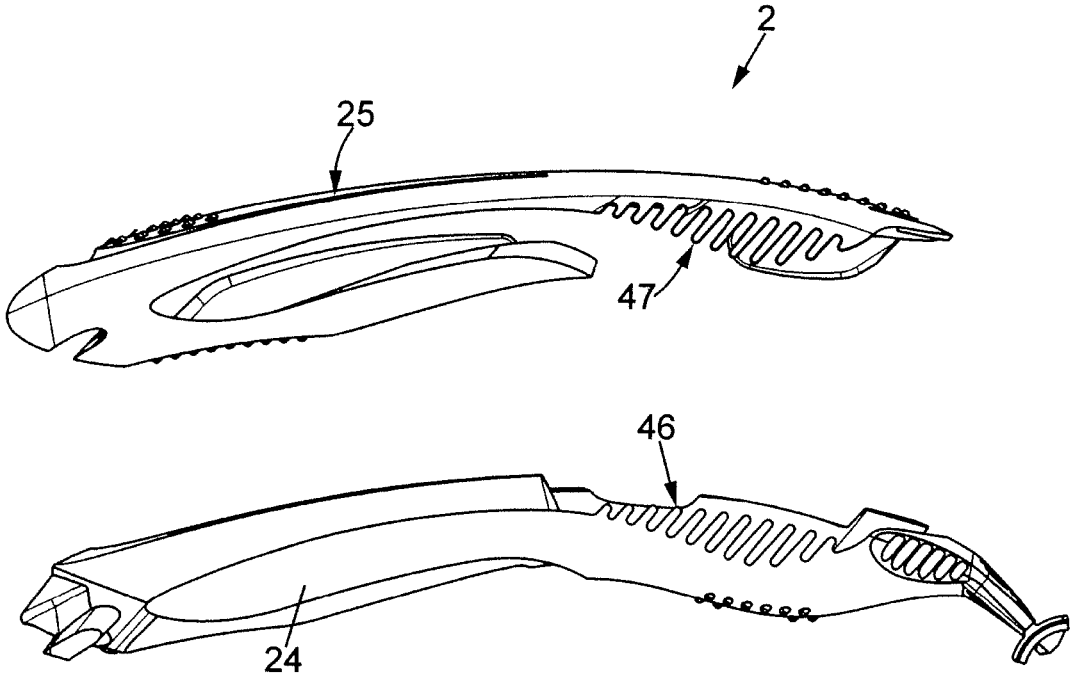
FIG. 14 is a side elevational exploded view showing the components of the razor handle of the preceding Figs.
Figure 15:
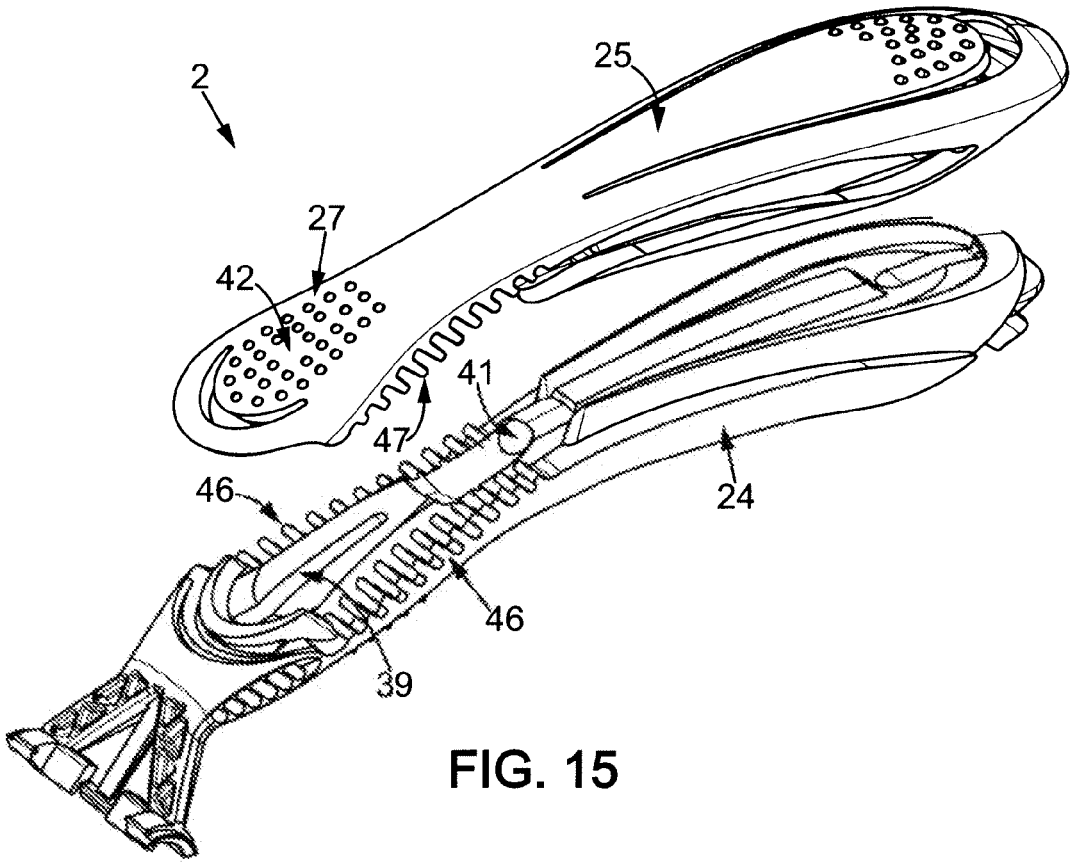
FIGS. 15 and 16 are respectively a front top perspective view and a back bottom perspective view showing the elastomeric member and the rigid member that comprise the razor handle of the preceding Figs.
Figure 16:
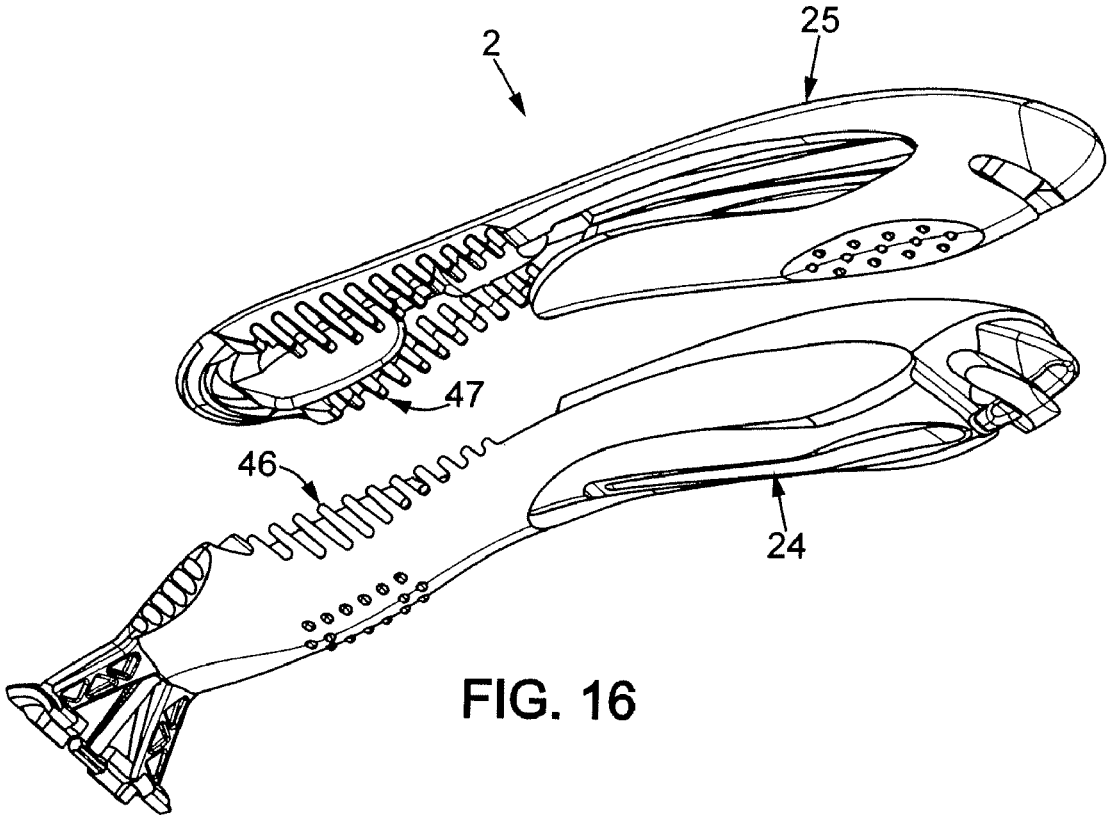
Figure 17F:
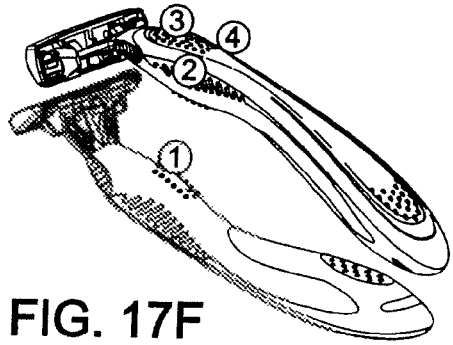
Figure 17G:
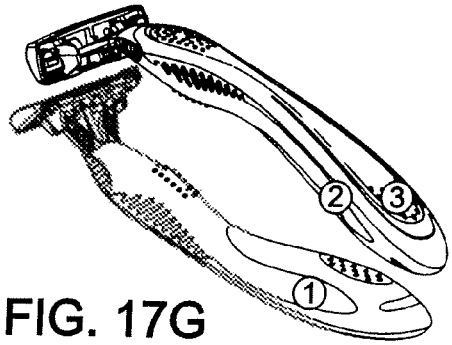

More specifically, in the region of the neck portion 17, the rigid core 24 and the layer 25 of compressible material define complementary comb-like structures 46, 47 embedded and imbricated in each other as depicted in FIGS. 14-16. In the neck portion 17, the elastomeric layer 25 is wider than the rigid core 24, so that the elastomeric fins 45 extend laterally outside from the rigid core 24, thereby providing better finger gripping in certain positions, especially the first position (FIG. 17A), second position (FIG. 17B) and sixth position (FIG. 17F).

Figure 9:
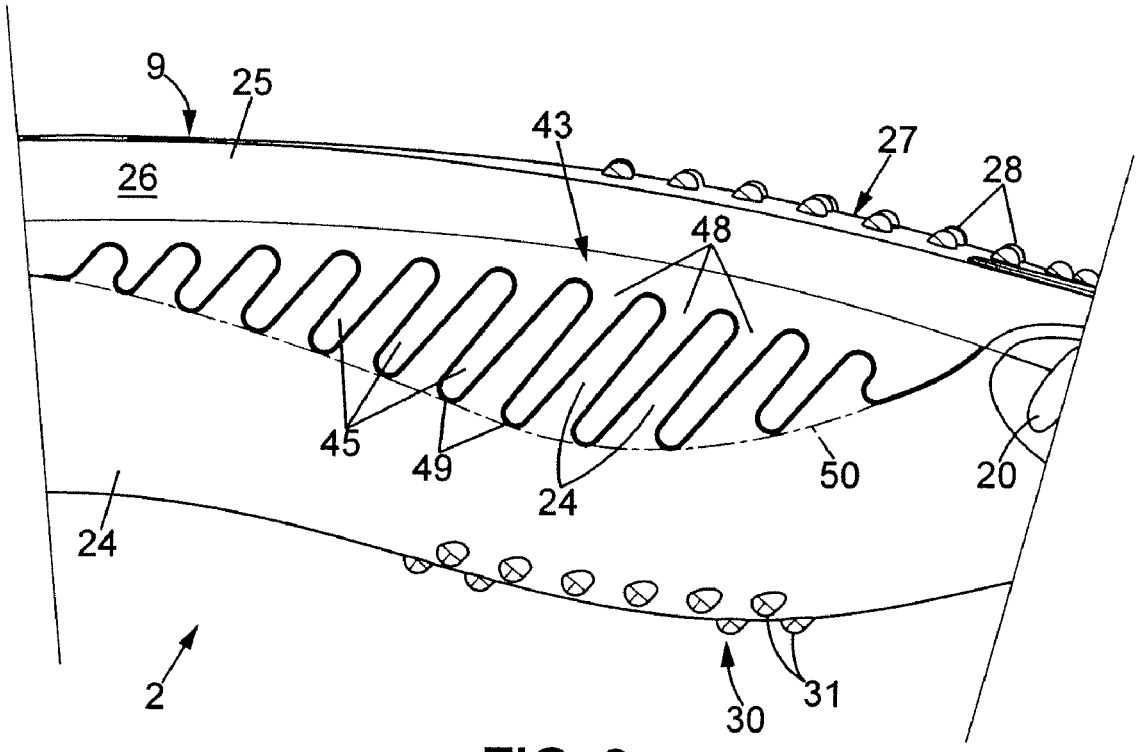
FIG. 9 is an enlarged side view of the razor handle of the preceding Figs.

As depicted in FIG. 9, each fin 45 extends from a root 48, located in the side overflowing portion 26 of the elastomeric layer 25 near the upper surface 9, to an end 49 located on the side surface 11, 12 at a distance from the upper surface 9. It can also be seen in FIG. 9 that the fins 45 are parallel and each inclines backwards, from the root 48 to the end 49, with respect to a plane perpendicular to the upper edge L1 of the handle 2 (which corresponds, as disclosed hereabove, to the intersection of the symmetry plane P and the upper surface 9 of the handle 2). Such an inclination improves the ergonomics of the handle 2, especially in the first position (FIG. 17A), where the fins 45 extend substantially perpendicular to the axis of the index finger. In one embodiment, the distance between two adjacent fins 45 is approximately 1 mm, whereas the fins 45 have a depth less than 0.5 mm, and more preferably 0.2 mm, and a width that is greater than the depth, and more specifically, approximately 1 mm.

The imbricate structure of the side gripping areas 43, 44 provides a good compromise between softness (via the elastomeric fins 45) and rigidity (via the rigid core 24) for firm and comfortable grasping of the razor handle 2, especially in the first position (FIG. 17A).

As depicted in FIG. 9, the ends 49 of the fins 45 together form a continuously curved limit 50 (in phantom) of the corresponding side gripping areas 43, 44, in order to match as closely as possible, the roundness of the finger tips, especially in the first position (FIG. 17A), thereby enhancing comfort of hand grasping.

Figure 8:
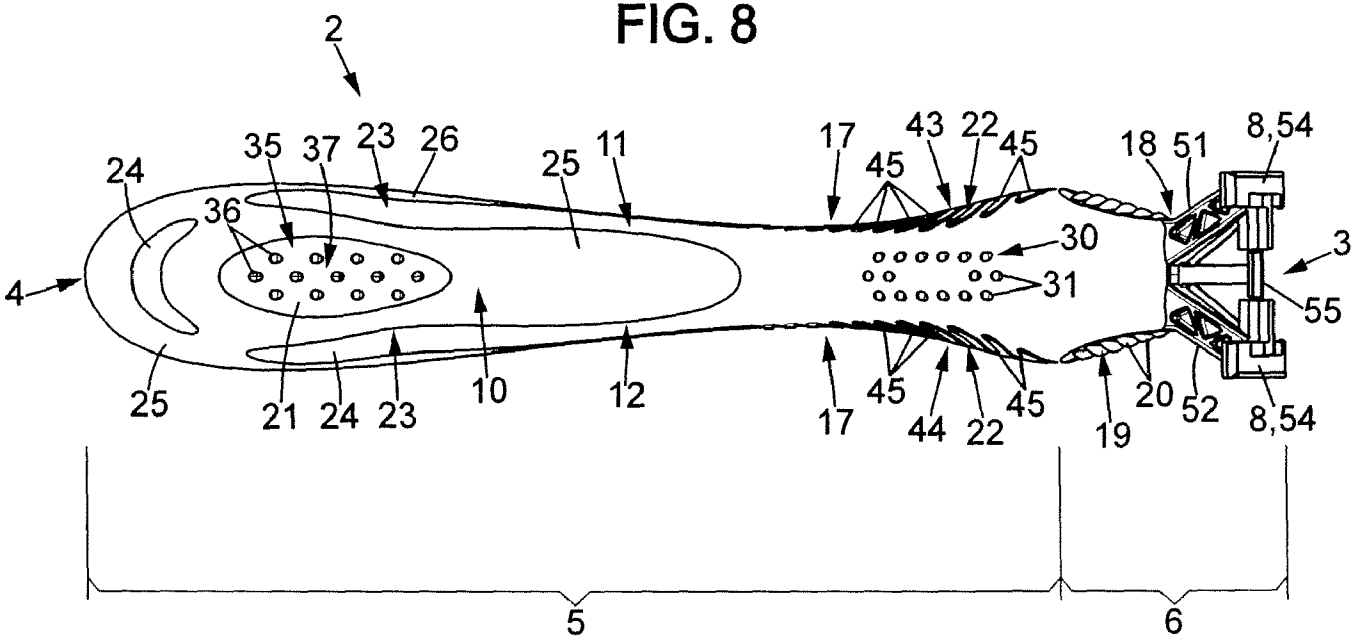
FIG. 8 is a bottom plan view of the razor handle of the preceding Figs.
Figure 11:
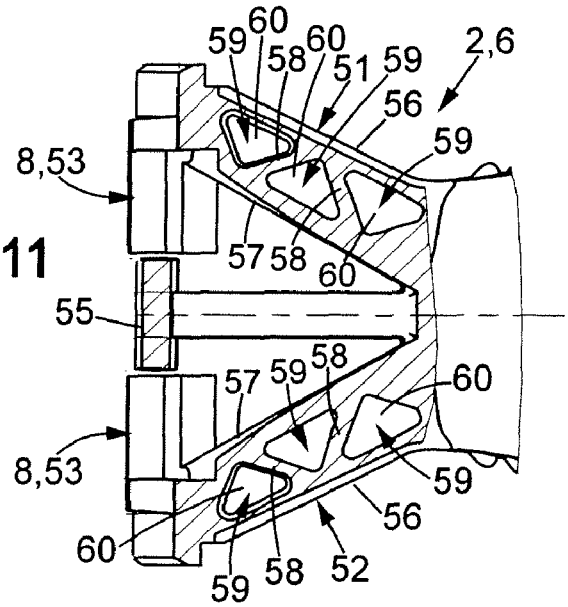
FIG. 11 is a partial cross-sectional view showing the head portion of the razor handle of FIG. 3, taken along the line XI-XI.
Figure 12:
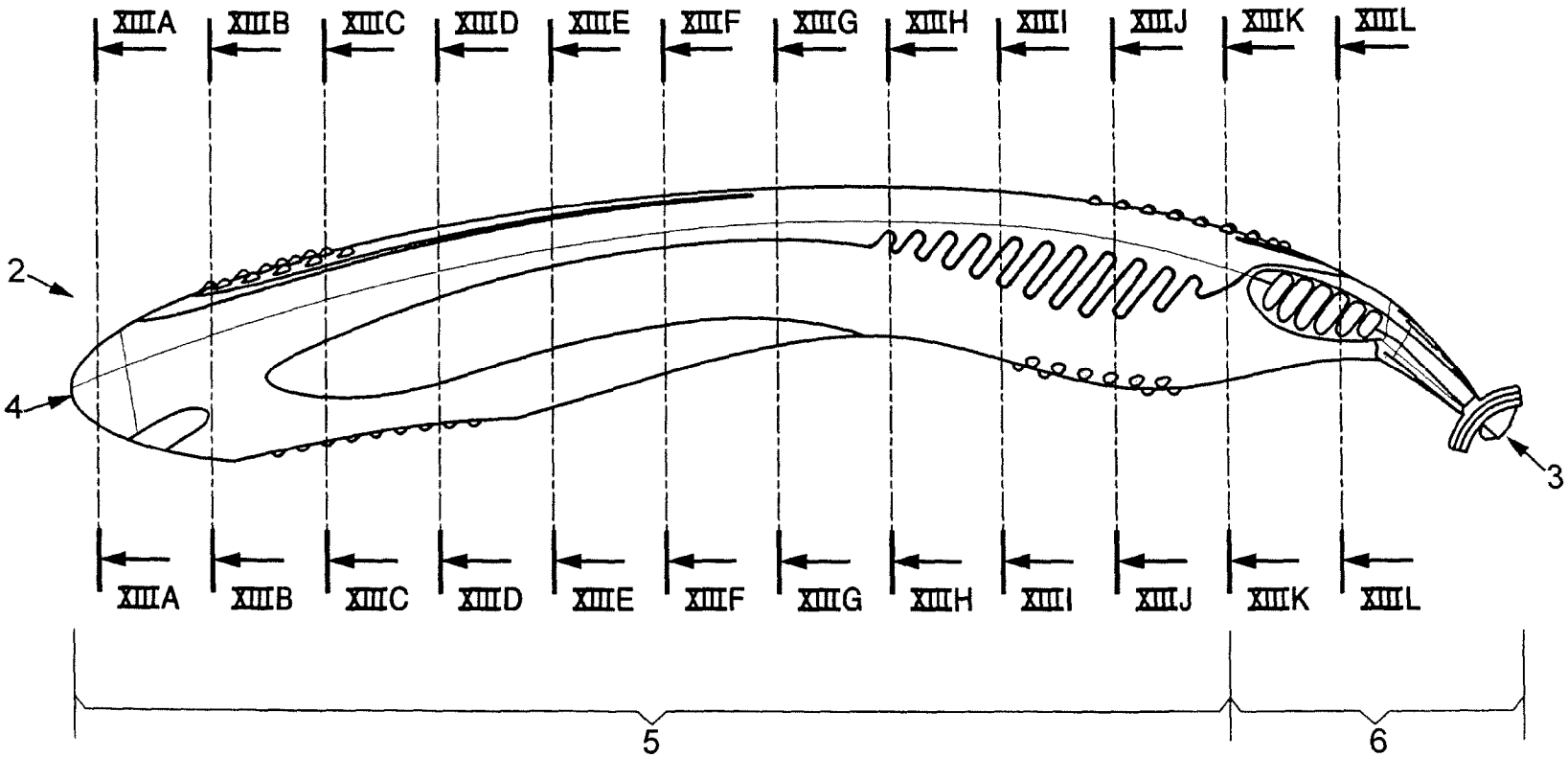
FIG. 12 is a side elevational view of the razor handle of the preceding Figs., showing the opposite side of the razor handle depicted in FIG. 3.

Turning now to FIGS. 7, 8 and 11, it can be seen that the head portion 6 of the razor handle 2 has a V-shaped pair of spaced arms 51, 52 each provided, at an end thereof, with a bearing structure 8 for connection to the a razor head 7.

In the disclosed embodiment, the razor head 7 is of the swiveling type, the bearing structures 8 comprising arcuate rails 53 clipped into corresponding hooks 54 provided on the razor head 7, wherein a longitudinal flexible tongue 55, extending between the arms 51, 52 and cooperating with a groove formed on the razor head 7, provides a spring force which biases the razor head 7 towards a median rest position as illustrated in FIG. 1.

As depicted in FIG. 11, each arm 51, 52, which is integral with the rigid core 24, has a reticulated structure, and comprises a pair of side walls 56, 57 interconnected by a series of transverse stiffeners 58 that are inclined at approximately 45° with respect to the side walls 56, 57, thereby together defining, from a top view, a series of triangular-shaped cavities 59. Such a structure provides enough structural strength to the head portion 6 for the purposes of human shaving, while saving handle 2 weight and costs.

In the depicted embodiment, where the razor 1 is of the disposable type, which means that once mounted on the handle 2, the razor head 7 does not have to be dismounted, each arm 51, 52 comprises a median wall 60 interconnecting the side walls 56, 57, and perpendicular to the side walls 56, 57 and to the stiffeners 58, thereby increasing longitudinal rigidity of the arms 51, 52.

It can be appreciated from FIGS. 3 and 11 that, from a side and top view, each arm 51, 52 has a width that decreases towards the end of the arms 51, 52, thereby further reducing handle 2 weight without losing structural strength.

As a result of all the described features, the razor handle 2 has an enhanced design that improves finger gripping and provides more hand grasping comfort during shaving operations than known razor handles.

What is claimed is:

1. A razor handle made of a rigid core and a layer of elastomeric material disposed on at least a portion of the rigid core, the razor handle comprising:

a head portion disposed at a front end of the razor handle, and a back end opposite the front end, the head portion having a bearing structure for connection to a razor head; and a body portion comprising:

an upper surface;

a lower surface opposite the upper surface, wherein the rigid core at least partially defines the lower surface;

an upper front gripping area having a first plurality of spaced pins protruding from the upper surface, the upper front gripping area being formed as a single unitary structure with the layer of elastomeric material and being centered on a point located at a distance of at least 3 cm from a front end of the head portion;

a lower front gripping area located opposite the upper front gripping area, the lower front gripping area being formed as a single unitary structure with the rigid core and having a second plurality of spaced pins protruding from the lower surface, the second plurality of spaced pins having the same size and shape as the first plurality of spaced pins;

an upper back gripping area having a third plurality of spaced pins protruding from the upper surface, the upper back gripping area being formed as a single unitary structure with the layer of elastomeric material, the third plurality of spaced pins having the same size and shape as the first plurality of spaced pins; and a lower back gripping area having a fourth plurality of spaced pins protruding from the lower surface, the lower back gripping area being formed as a single unitary structure with the layer of elastomeric material, the fourth plurality of spaced pins having the same size and shape as the first plurality of spaced pins.

2. The razor handle according to claim 1, wherein the upper front gripping area has a shape adapted to receive an index finger tip.

3. The razor handle according to claim 1, wherein the upper front gripping area is approximately 2 cm in length.

4. A razor handle comprising:

a head portion having a front end, a back end opposite the front end, and a bearing structure at the front end for connection to a razor head; and a body portion extending longitudinally and comprising:

a front end;

a back end opposite the front end;

an upper surface;

a lower surface opposite the upper surface;

an upper front gripping area having a first plurality of spaced pins protruding from the upper surface, the upper front gripping area being formed as a single unitary structure with a layer of elastomeric material and being centered on a point located at a distance of at least 3 cm from the front end of the head portion;

an upper back gripping area having a second plurality of spaced pins protruding from the upper surface, the upper back gripping area being formed as a single unitary structure with the layer of elastomeric material and being centered on a point located at a distance approximately 2 cm from a back end of the body portion, the second plurality of spaced pins having the same size and shape as the first plurality of spaced pins, a lower front gripping area located opposite the upper front gripping area, the lower front gripping area being formed as a single unitary structure with a rigid core and having a third plurality of spaced pins protruding from the lower surface, the third plurality of spaced pins having the same size and shape as the first plurality of spaced pins; and a lower back gripping area having a fourth plurality of spaced pins protruding from the lower surface, the lower back gripping area being formed as a single unitary structure with the layer of elastomeric material, the fourth plurality of spaced pins having the same size and shape as the first plurality of spaced pins, wherein the upper back and upper front gripping areas are separated longitudinally by an area free of spaced projections protruding from the upper surface.

5. The razor handle according to claim 4, wherein the layer of elastomeric material at least partially defines the upper surface and the lower surface in the vicinity of the back end of the razor handle.

6. The razor handle according to claim 4, wherein the lower back gripping area is located in a recess formed in the lower surface.

7. The razor handle according to claim 4, wherein the lower back gripping area is centered on a point located at a distance approximately 2.5 cm from the back end of the body portion.

8. The razor handle according to claim 7, wherein the distance between the lower back gripping area and the upper front gripping area ranges between approximately 7 cm to approximately 9 cm.

9. A razor handle having a rigid core and a layer of elastomeric material disposed on at least a portion of the rigid core, the razor handle comprising:

a head portion disposed at a front end of the razor handle, the head portion having a bearing structure at a front end of the head portion; and a body portion extending longitudinally and having a front end and a back end opposite the front end and comprising:

an upper surface;

a lower surface opposite the upper surface, wherein the rigid core at least partially defines the lower surface;

an upper front gripping area that includes a first plurality of spaced pins protruding from the upper surface, the upper front gripping area being formed as a single unitary structure with the layer of elastomeric material;

a lower front gripping area located opposite the upper front gripping area, the lower front gripping area being formed as a single unitary structure with the rigid core and having a second plurality of spaced pins protruding from the lower surface, the second plurality of spaced pins having the same size and shape as the first plurality of spaced pins;

an upper back gripping area having a third plurality of spaced pins protruding from the upper surface, the upper back gripping area being formed as a single unitary structure with the layer of elastomeric material, the third plurality of spaced pins having the same size and shape as the first plurality of spaced pins; and a lower back gripping area having a fourth plurality of spaced pins protruding from the lower surface, the lower back gripping area being formed as a single unitary structure with the layer of elastomeric material, the fourth plurality of spaced pins having the same size and shape as the first plurality of spaced pins.

10. A razor handle comprising:

a rigid core;

a layer of elastomeric material;

a head portion at a front end of the razor handle;

a back end opposite the front end;

a bearing structure connected to the head portion; and a body portion extending longitudinally and comprising:

an upper surface;

a lower surface opposite the upper surface, wherein the rigid core at least partially defines the lower surface;

an upper front gripping area having a first plurality of spaced pins protruding from the upper surface, the upper front gripping area being formed as a single unitary structure with the layer of elastomeric material and being centered on a point located at a distance of at least 3 cm from the front end of the head portion;

a lower front gripping area located opposite the upper front gripping area, the lower front gripping area being formed as a single unitary structure with the rigid core and having a second plurality of spaced pins protruding from the lower surface, the second plurality of spaced pins having the same size and shape as the first plurality of spaced pins;

an upper back gripping area having a third plurality of spaced pins protruding from the upper surface, the upper back gripping area being formed as a single unitary structure with the layer of elastomeric material, the third plurality of spaced pins having the same size and shape as the first plurality of spaced pins; and a lower back gripping area located opposite the upper back gripping area, the lower back gripping area having a fourth plurality of spaced pins protruding from the lower surface, the fourth plurality of spaced projections being formed as a single unitary structure with the elastomeric layer, the fourth plurality of spaced pins having the same size and shape as the first plurality of spaced pins.

11. A razor comprising:

a razor head; and a razor handle having a front end, a back end opposite the front end, a rigid core, and a layer of elastomeric material disposed on at least a portion of the rigid core, the razor handle comprising:

a head portion having a bearing structure for connection to the razor head; and a body portion comprising:

an upper surface;

a lower surface opposite the upper surface;

an upper front gripping area that includes a first plurality of spaced pins protruding from the upper surface, the upper front gripping area being formed as a single unitary structure with the layer of elastomeric material;

a lower front gripping area located opposite the upper front gripping area, the lower front gripping area being formed as a single unitary structure with the rigid core and having a second plurality of spaced pins protruding from the lower surface, the second plurality of spaced pins having the same size and shape as the first plurality of spaced pins;

an upper back gripping area having a third plurality of spaced pins protruding from the upper surface, the upper back gripping area being formed as a single unitary structure with the layer of elastomeric material, the third plurality of spaced pins having the same size and shape as the first plurality of spaced pins; and a lower back gripping area having a fourth plurality of spaced pins protruding from the lower surface, the lower back gripping area being formed as a single unitary structure with the layer of elastomeric material, the fourth plurality of spaced pins having the same size and shape as the first plurality of spaced pins.

* * * * *